United States Patent [19]

Bishop

[11] Patent Number: 4,474,298

[45] Date of Patent: Oct. 2, 1984

[54] NECKTIE ORGANIZER

[76] Inventor: Vance D. Bishop, 5922 9th Ave., North, St. Petersburg, Fla. 33710

[21] Appl. No.: 459,225

[22] Filed: Jan. 19, 1983

[51] Int. Cl.[3] ..... A47F 7/19

[52] U.S. Cl. ..... 211/118; 211/113; 223/85; 29/433; 29/525

[58] Field of Search ..... 211/118, 113, 119, 123, 211/105.1; 223/85, 88; 29/525, 433

[56] References Cited

U.S. PATENT DOCUMENTS

| | | | |
|---|---|---|---|
| 1,723,980 | 8/1929 | Freeman | 223/88 |
| 2,165,814 | 7/1939 | Redmond | 211/123 X |
| 2,510,452 | 6/1950 | Witt | 211/89 |
| 3,049,272 | 8/1962 | Tufts | 223/88 |
| 3,452,881 | 7/1969 | Jamison | 223/85 X |
| 4,415,093 | 11/1983 | Livingston | 223/85 X |

*Primary Examiner*—William H. Schultz
*Assistant Examiner*—Robert W. Gibson, Jr.
*Attorney, Agent, or Firm*—L. Lawton Rogers, III

[57] ABSTRACT

A necktie organizer of the type adapted to hang over a closet pole in which the tie supporting rod is provided with separaters to define sections in which ties might be organized by color, or the like, and in which the tie support of each of the sections is rotatable independently of the other sections. A novel method of construction of a necktie organizer is also disclosed in which a rod is passed through an aperture in one of two spaced supports and tubes and washers alternated thereon until the rod spans the supports.

7 Claims, 5 Drawing Figures

NECKTIE ORGANIZER

BACKGROUND OF THE INVENTION

Necktie hangers adapted for hanging on closet poles are well known. They typically comprise a frame having the general shape of a coat hanger. If a number of ties are draped across a single rod, the ties tend to slide laterally across the rod as the hanger tilts when ties are placed on and removed therefrom. Such necktie hangers do not serve as necktie organizers in that the ties are not separated by dividers. In addition, the placing and/or removal of a necktie from the rod often results in the unwanted removal of other ties from the rod as a result of contact between the neckties.

Various methods have been devised to maintain the separation of ties. One such method involves the use of an elastromeric band such as disclosed in the Hart U.S. Pat. No. 3,967,766 dated July 6, 1976. Tie hangers of this type have the disadvantage that they generally require the use of two hands to hang or to remove a necktie from the hanger and can hold only a few ties.

Other necktie hangers use individual tie supports which may be secured at spaced intervals to the rod of the necktie hanger frame at spaced intervals to thereby ensure separation of the ties along the rod. Such necktie hangers may require the use of spring clips or the like to hold the individual ties on the individual tie hangers. An example of this type of necktie hanger is disclosed in the Witt U.S. Pat. No. 2,510,452 dated June 6, 1950. One of the problems associated with this type of hanger is the fact that the ties are hung at right angles to the necktie hanger and are thus subject to crushing by other clothes in the closet.

Still other necktie racks, such as the Behlefeldt U.S. Pat. No. 2,748,953 dated June 5, 1956 provide spacers for the ties and thus can serve as tie organizers. However, such racks require two hands to operate and tend to be complex in construction.

It is accordingly an object of the present invention to provide a novel method of construction in necktie organizing which obviates the problems associated with known prior necktie racks.

More specifically, it is an object of the present invention to provide a necktie organizer in which the placing of a tie on or the removal from the supporting rod does not effect ties in adjacent compartments.

Another object of the present invention is to provide a necktie organizer which is simple in construction and inexpensive to manufacture.

These and many other objects and advantages of the present invention will be readily apparent from the claims and from the following detailed description when read in conjunction with the appended drawings.

THE DRAWINGS

THE DETAILED DESCRIPTION

Figure 1:
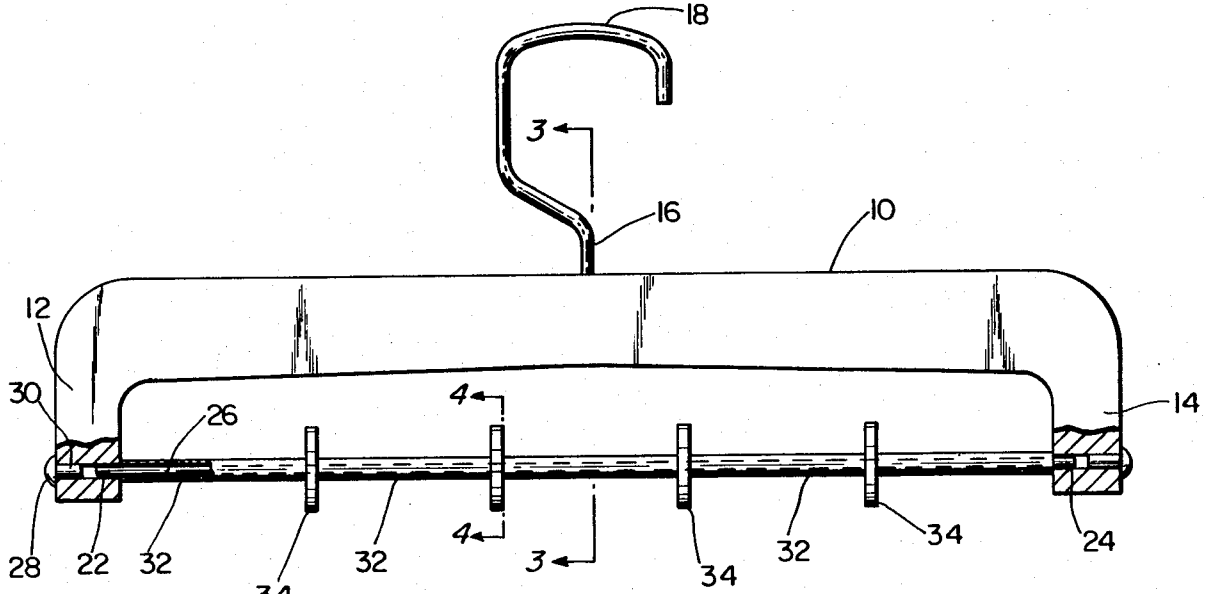
FIG. 1 is a front elevation of one embodiment of the necktie organizer of the present invention.
Figure 2:
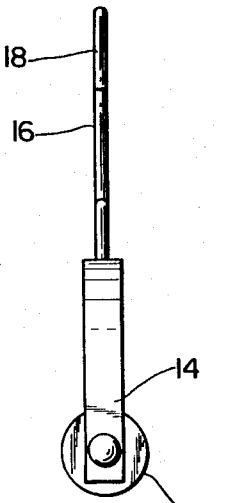
FIG. 2 is an end view of the necktie organizer of FIG. 1.
Figure 3:
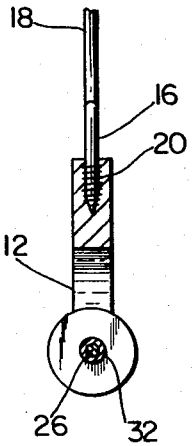
FIG. 3 is a vertical section taken through lines 3—3 of the necktie of FIG. 1.
Figure 4:
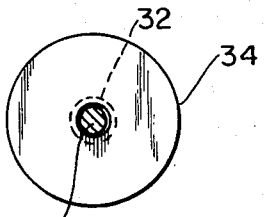
FIG. 4 is a section in elevation taken through lines 4—4 of the necktie organizer of FIG. 1.

With reference to the Figures where alike numerical designations have been accorded like elements for ease and understanding the present invention, the necktie organizer comprises a frame member having a horizontal section 10 and two vertical sections 12 and 14 depending therefrom. The frame may be provided with a hook 16 having an upper portion 18 adapted to overlie the closet pole and an end portion 20 threaded for securing to the frame.

It should be recognized that the frame and hook may be integral and molded out of plastic or metal, or alternatively made out of wood with a metal hook.

With continued reference to the Figures, the two vertical end portions 12, 14 of the frame are provided with a coaxial apertures into which the ends 22, 24 of a rod 26 may be inserted. A pair of plugs having a head portion 28 and a shaft portion 30 may be inserted into the apertures to prevent removal of the rod 26 therefrom.

The entirety of the horizontal space between the vertical support member 12, 14 may be taken by a plurality of tubes 32 alternating with washers 34. As shown more clearly in FIG. 5, the washers 34 and tubes 32 alternate on the rod 26 so that the tubes 32 ensure the spacing of the washers 34 along the length of the rod 26.

Figure 5:
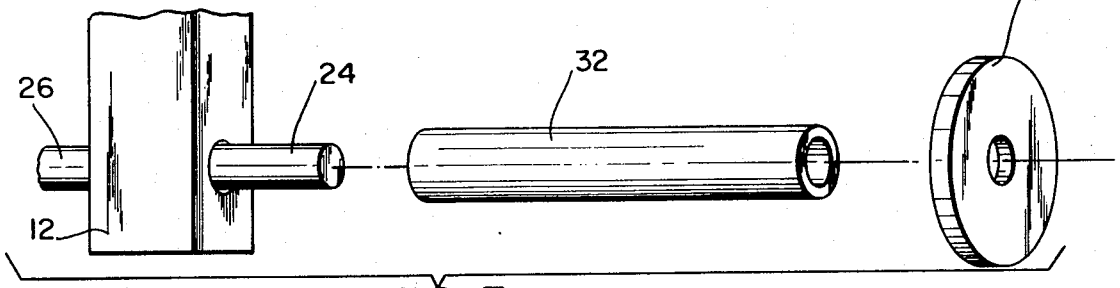
FIG. 5 is an exploded pictorial view illustrating the method of construction of the necktie organizer of FIG. 1.

With continued reference to FIG. 5, the tie organizer of the present invention may be constructed by the insertion of one end 24 of the rod 26 through the aperture in one of the support members, e.g., member 12. As the rod 26 projects through the member 12, the washers 34 and tubes 32 placed thereon until the space between the vertical supports 12, 14 is fully occupied, at which point the end 24 is inserted into the aperture in the support 14. Thereafter, plugs may be inserted into the apertures in the supports 12, 14 to ensure that the rod 26 remains in place.

It has been found desirable for the outside diameter of the washers 34 to be approximately $\frac{3}{4}$ inches or more. The inside diameter of the washers 34 may approximate that of the outside diameter of the rod 26. This fit, however, is not critical. For ease in construction, some looseness is desirable.

Likewise, the relationship between the inside diameter of the tubes 32 and the rod 26 is not critical. It is, however, necessary for the outside diameter of the tubes 32 to be larger than the inside diameter of the washers 34 so that the tubes 32 form spaces between the washers 34, i.e., about one and one-half to two times the inside diameter of the tubes 32.

In use, the tie may be placed onto or removed from the tie organizer with one hand. The tipping of the tie organizer from the horizontal in the removal process does not result in all of the neckties sliding to one end of the organizer because of the position of the washers 34. The removal of an necktie from the organizer may result in the rotation of the tube 32 on which the necktie rests due to contact there between. However, the rotation of one of the tubes 32 will not affect the rotation of any of the other tubes and thus the other neckties on the organizer will not be disturbed. Similarly, the washers themselves may be independently rotatable about the rod 26. The plugs 28 may be force fit into the apertures in the supports 12, 14 or alternatively secured in any suitable conventional manner such as by an adhesive.

These and many other advantages will be apparent from the claims and it is to be understood that the foregoing is a description of a preferred embodiment, that many modifications will occur to those skilled in the art, and that the invention is limited to the language of the following claims when accorded a full range of equivalents.

What is claimed is:

1. A necktie organizer comprising:

a frame having a relatively long horizontal member and a relatively short vertical member depending from each end thereof, each of said vertical members having a horizontal channel adjacent the lower end thereof, said channels being circular in cross-section, coaxial and having a common diameter;

an upwardly extending hook carried by the horizontal member of said frame at the approximate midpoint of the horizontal length thereof;

a cylindrical rod carried by the vertical members of said frame with the ends thereof disposed in one of the channels in said vertical members;

a plurality of washers carried by said rod at spaced intervals intermediate the length thereof with said rod disposed in the central aperture therein, each of said washers having an internal diameter approximating the outside diameter of said rod and an outside diameter not less than about $\frac{3}{4}$ inch to thereby prevent the neckties manually placed on one side of a washer from sliding to the other side of that washer; and a plurality of cylindrical tubes carried by said rod with said rod disposed internally thereof, each of said tubes having an internal diameter approximating the outside diameter of said rod and the internal diameter of said plurality of washers, each of said tubes having an outside diameter greater than the inside diameter of said washers to thereby maintain the spacing between said washers, each of said plurality of tubes being disposed either between two of said plurality of washers or between one of said vertical members and one of said plurality of washers so that said tubes and said washers alternate along the length of said rod whereby neckties may be organized by color or the like by the manual placing thereof between two of said plurality of washers.

2. The necktie organizer of claim 1 wherein said rod extends into each of the channels in said vertical members approximately one-half of the length of the channels; and including a pair of plugs disposed one each in the channel of said vertical members, each of said plugs having a head and a shaft, said shaft having an outside diameter approximating the diameter of the channel in said vertical members and said head having a diameter sufficiently larger than the diameter of said channel to limit the penetration of said plugs into said channels, the length of said shaft being less than the distance between the end of said rod and said head whereby disposition of said plug in said channel leaves an axial space in said channel between said plug and said rod whereby rotation of said rod about the longitudinal axis thereof will not affect the security of said plug in said channel.

3. The necktie organizer of claim 2 wherein each of said plurality of washers and each of said plurality of tubes are freely rotatable about said rod independently of the others of said pluralitites of rods and tubes.

4. The necktie organizer of claim 3 wherein the outside diameter of said plurality of washer is not less than about $\frac{3}{4}$ inch; and wherein the outside diameter of said plurality of tubes is between about one and one-half and two times the internal diameter thereof.

5. The necktie organizer of claim 1 wherein each of said plurality of washers and each of said plurality of tubes are freely rotatable about said rod independently of the others of said pluralitites of rods and tubes.

6. A method of constructing a necktie organizer comprising the steps of:

(a) providing a frame having horizontally spaced support members coaxially apertured and a rod adapted for insertion into the apertures, the length of the rod being greater than the separation between the support members;

(b) providing a plurality of washers and tubes adapted to be carried by the rod;

(c) inserting one end of the rod through the aperture in one of the supports;

(d) continuing to insert the rod through the aperture in said one support while alternating tubes and washers on the portion of the rod between the supports to substantially fill up the space between the supports; and (e) continuing to insert the rod through the aperture in said one support until the rod enters the aperture in the other support to thereby support the washers and tubes between the supports.

7. The method of claim 6 including the further step of plugging the apertures in both of the supports to thereby prevent withdrawal of the rod from between the supports.

* * * * *